US005717276A

United States Patent [19]

Hsu

[11] Patent Number: 5,717,276

[45] Date of Patent: Feb. 10, 1998

[54] FLEXIBLE LIGHT

[76] Inventor: Chin-tien Hsu, No. 3, Alley 15, Lane 54, Fute 2nd Rd., Hsitzu Chen, Taipei Hsien, Taiwan

[21] Appl. No.: 716,637

[22] Filed: Sep. 13, 1996

[51] Int. Cl.[6] ..... F21L 7/00

[52] U.S. Cl. ..... 313/318.01; 362/198; 362/199; 362/187

[58] Field of Search ..... 313/318.01; 362/187, 362/198, 199, 197

[56] References Cited

U.S. PATENT DOCUMENTS 1,097,023 5/1914 Hirsch ..... 362/197

5,176,438 1/1993 Fisherman ..... 362/198

5,315,493 5/1994 Huang ..... 362/187

*Primary Examiner*—Nimeshkumar Patel

*Attorney, Agent, or Firm*—Parkhurst, Wendel & Burr, L.L.P

[57] ABSTRACT

A flexible light includes a lens cap having a light bulb received therein, a bulb holder threadingly received the light bulb therein and threadingly engaging to the lens cap, a bellows having a first end which snugly engages with the bulb holder and a second end which snugly engages with a holding portion, wherein a flexible element is inserted within the bellows such that the flexible light is able to bend in great extent.

4 Claims, 5 Drawing Sheets

FLEXIBLE LIGHT

FIELD OF THE INVENTION

The present invention generally relates to a flexible light, and more particularly to a flexible light using a flexible element made of metal as a bending means.

BACKGROUND OF THE INVENTION

A prior flexible light, referring to FIG. 5, is a light capable of bending so as to conform to an object, such as neck, arm or any other object having tubular shape. The structure of prior flexible light comprises a seat 90, a handle 91 and a plurality of joints 92 connected therebetween and having a bellows 93 enclosing the joints. The joints 92 are composed of members 920 each having two spherical heads (not shown) and a spherical seat. Each head is pivotally received within the respective spherical seat 921, such that every joint 92 provides a limited flexible ability to the prior flexible light enabling it to bend and conform to any object, particularly one having tubular shape.

Such a flexible light suffers several disadvantages, which are:

(1) Complexity in structure:

As described earlier, the joints 92 of the flexible light is composed of a plurality of members 920 each having two spherical heads and each head being pivotally received within a spherical seat 921. Because the members 920 and seat 921 within the flexible light are very complex, it takes time to assemble the light, and also a wire (not shown) transmitting electricity from batteries (not shown) needs to go through the members 920 and seat 921, which also increases difficulty in assembling the light.

(2) Limitation in flexibility:

Because the flexibility of the light is resulted from the plurality of members 920 each being pivotally received within the spherical seat 921, when the distance between each joint 92 is shorter, thus the flexibility of the light will become larger and vice versa. Therefore, due to the fixed distance between each joint 92, the light of prior art is not able to be flexible in great extent.

(3) Life span is limited:

When the member 920 is pivotally rotating within the spherical seat 921, friction between the member 920 and the spherical seat 921 will gradually erode the interface therebetween resulting in that the light can no longer be kept in a specific angle for a long time.

(4) Focus is fixed:

The structure of the seat 90 means that the light has no ability to have its focus of light adjusted.

Thus, the flexible light constructed in accordance with the present invention tends to mitigate and/or obviate the aforementioned problems.

SUMMARY OF THE INVENTION

The main objective of the invention is to provide a flexible light which is able to be bent in great extent. The flexible light includes a bulb holder combined with a front seat, a rear seat combined with a holding portion, a flexible element inserted therebetween and having a bellows surrounding an outer surface thereof. A light bulb is threadingly inserted into a front end of the bulb holder, and the holding portion having a battery chamber provided therein is threadingly connected to the rear seat. Additionally, a lense cap is threadingly connected with the bulb holder and has the light bulb received therein. The flexible light constructed in accordance with the present invention is able to extend into any object even when the diameter of the object is quite small.

Another object of the invention is to provide a flexible light which is able to have its focus of light varied through adjusting the depth of the cover inserting into the bulb holder.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
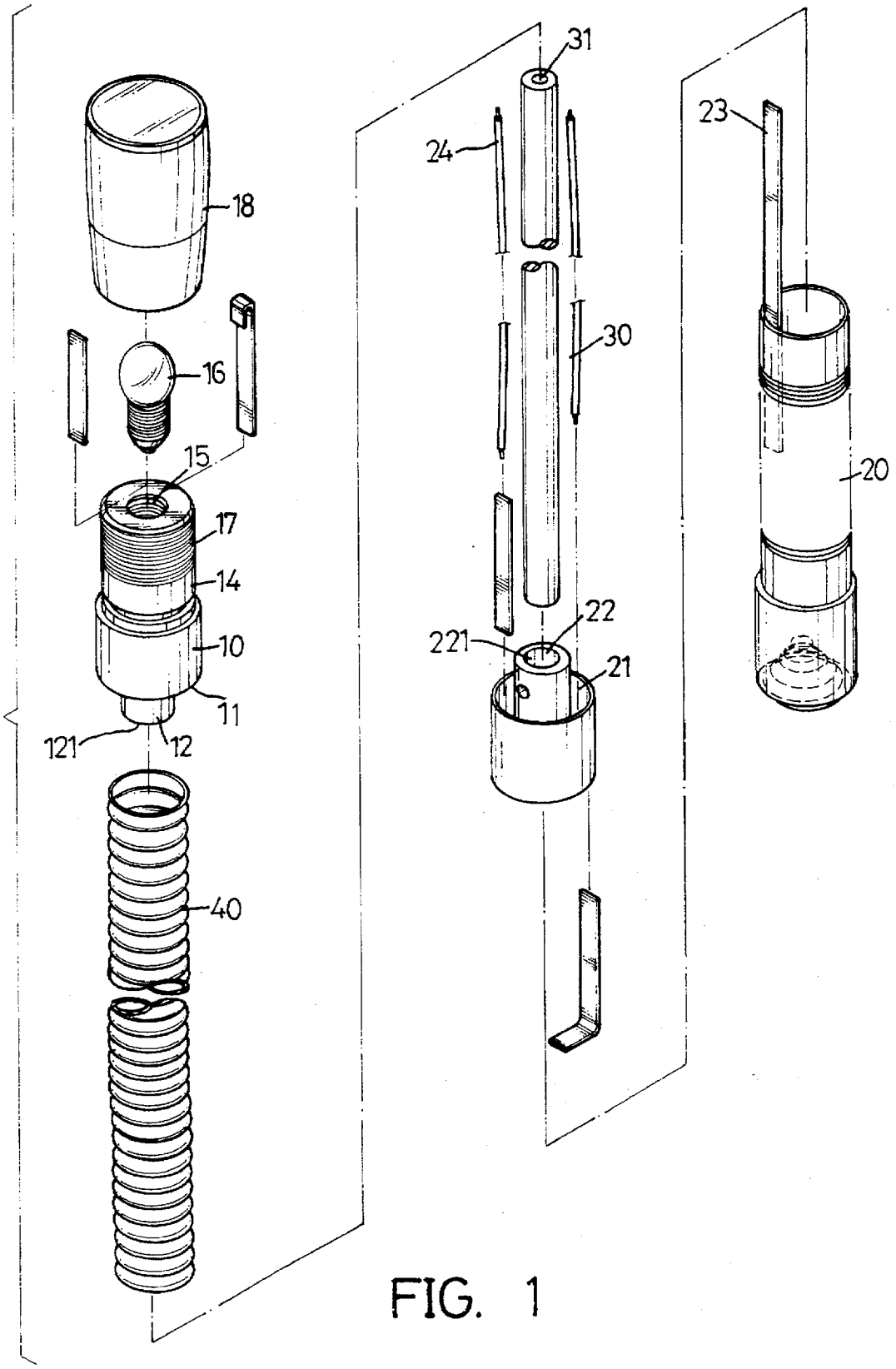
FIG. 1 is an exploded view of the invention.
Figure 2:
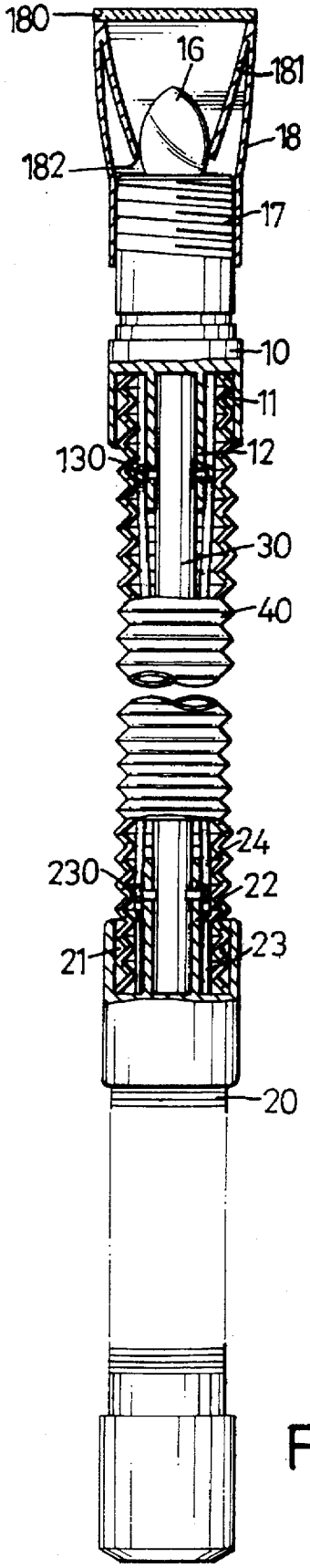
FIG. 2 is a partial cross sectional view of the invention showing the connecting relationship between each element.
Figure 3:
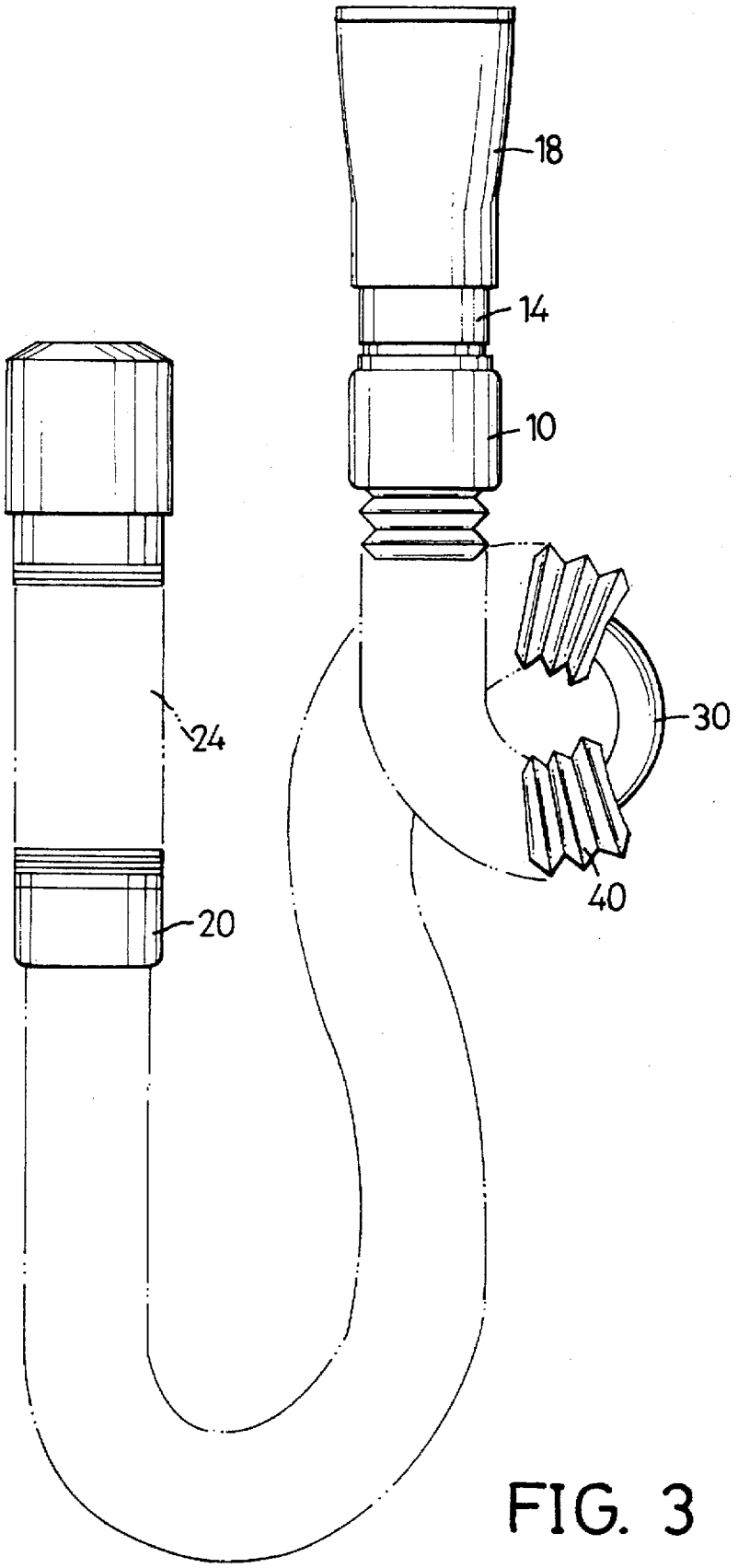
FIG. 3 is one preferred embodiment of the invention.

Referring to FIGS. 1 and 2, one preferred embodiment of the invention is shown. A flexible light source constructed in accordance with the present invention includes a bulb holder 10, a handle 20, a flexible element 30 extending between the bulb holder 10 and the handle 20, and a bellows 40 enclosing the flexible element 30.

The flexible element 30 is tubular and made of a highly flexible material, such as plastic or metal.

The handle 20 is hollow and contains batteries (not shown) as in a conventional flash light.

The bulb holder 10 has a first end 15 in which a bulb 16 is threadingly received. The bulb holder 10 has a first of a pair of seats (not numbered) integrally formed at a second end thereof. The handle 20 has the second of the pair of seats threadingly engaged to a first end thereof. Each seat includes a flat base and from one side of which an outer flange (also not numbered) and an inner tubular projection 12, 22 extend. A recess 11, 21 is defined Between each respective outer flange and inner tubular projection 12, 22. A closed bore is defined in each tubular projection.

A first end of the bellows is snugly received in the recess 11 of the seat of the bulb holder and a second end of the bellows is snugly received in the recess 21 of the seat of the handle 20, as shown in FIGS. 1 and 2.

Each end of the flexible element 30 is received within the closed bore of a respective one of the seats. A plurality of pins 130, 230 radially extend through each tubular projection to embed in the respective ends of the flexible element 30 whereby the flexible element 30 is securely retained in the seats and thus also retaining the handle 20 and the bulb holder 10.

The bulb holder 10 has a threading 17 defined in an outer periphery at the first end thereof. A lens cap 19 is threadingly engaged to the bulb holder 10 at the threading 17 thereof. A bell shaped reflection plate 181 is integrally formed within the lens cap 18 and defines an opening 182 at a small end thereof through which the bulb 16 extends. A conventional spring contact (not shown) is disclosed between a bottom of the bulb 16 and an inner face of the bulb holder 10. A pair of conducting elements such as metal plates 23 and wires 24 extend opposingly from the batteries (not shown) of the handle 20 through the flat base and the recess 21 of the second seat along the outer periphery of the flexible element 30 and through the flat base and the recess of the first seat to transmit electricity of the batteries to connect with the spring contact and thus light the bulb 16. A conventional switch (not shown) is disposed on the handle 20 to achieve OFF/ON statuses.

Figure 4:
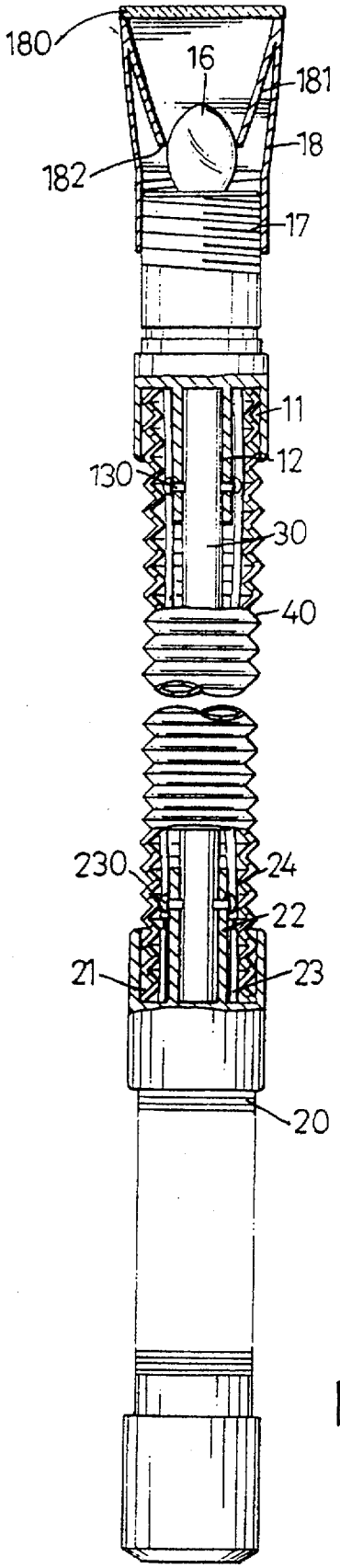
FIG. 4 is another preferred embodiment of the invention showing the adjustment of changing the depth of a cover inserting into the front seat.
Figure 5:
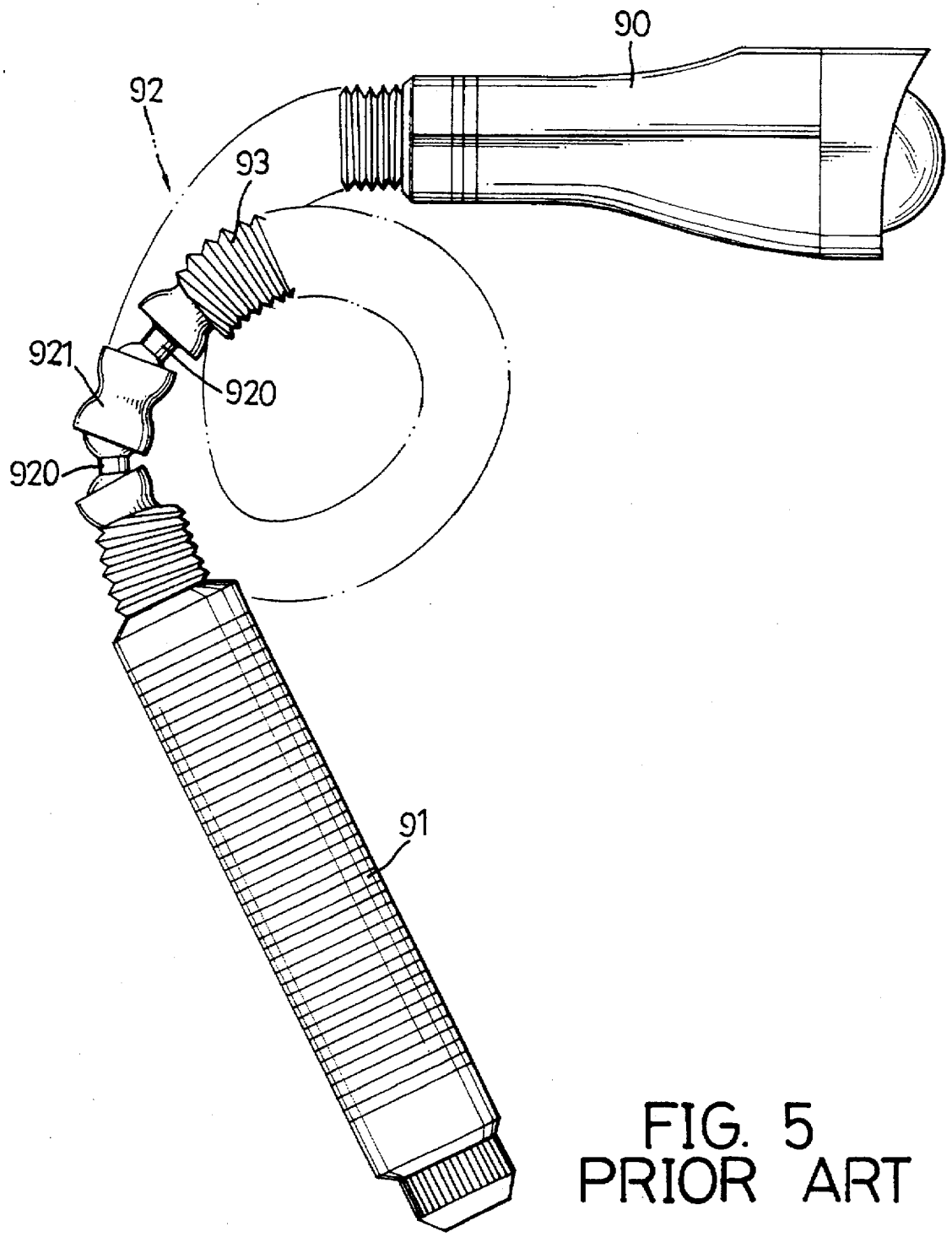
FIG. 5 PRIOR ART
FIG. 5 is a perspective view of a prior flexible light.

Referring to FIG. 4, if a user feels that the focus of the light is not concentrative enough, he/she may simply turn the cover 18 clockwise or counterclockwise to adjust the distance between a transparent end 180 to the light bulb 16, then the adjustment of the right focus of the flexible light constructed in accordance with the present invention is accomplished.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A flexible light comprising:

a bulb holder having a first seat with a first end with a first bore defined therein, a second end having a flat base and from one side of which a first outer flange and a first inner tubular projection extend, and a first recess defined between said first outer flange and said first inner tubular projection, wherein a first bore is defined;

a lens cap having a reflection plate provided thereon and an opening opposite to said reflection plate and threadingly connected with said bulb holder;

a bulb threadingly connected within said first end of said bulb holder and enclosed within said lens cap;

a hollow handle for receiving batteries therein with a second seat attached thereto, said second seat having an outer flange, an inner tubular projection which extends from a flat base thereof, a closed second bore relative to said first bore of said first seat and a recess defined between said flange and said inner tubular projection;

a bellow having two ends securely and respectively received within said recess of said first seat and said recess of said second seat;

a plurality of pins radially extending through each tubular projection to be embedded in the respective ends of a flexible element whereby said flexible element is securely retained in said handle and said bulb holder;

a conducting element extending from said handle through said flat base and said recess of said second seat along an outer periphery of said flexible element and through said flat base and said recess of said first seat to connect with said bulb.

2. The flexible light as claimed in claim 1, wherein said flexible element is made of materials having highly flexibility.

3. The flexible light as claimed in claim 1, wherein said conducting element is electrical wire.

4. The flexible light as claimed in claim 1, wherein said conducting element is metal plate.

* * * * *